US009580281B2

(12) United States Patent
Foley et al.

(10) Patent No.: US 9,580,281 B2
(45) Date of Patent: Feb. 28, 2017

(54) TUBING CLAMP ASSEMBLY

(71) Applicant: FOLEY ENGINEERING, LLC, Lafayette, LA (US)

(72) Inventors: Scott C. Foley, Abbeville, LA (US); Lawrence E. Foley, Lafayette, LA (US)

(73) Assignee: Foley Patents, LLC, Abbeville, LA (US)

( * ) Notice: Subject to any disclaimer, the term of this patent is extended or adjusted under 35 U.S.C. 154(b) by 482 days.

(21) Appl. No.: 14/335,885

(22) Filed: Jul. 19, 2014

(65) Prior Publication Data

US 2015/0021050 A1 Jan. 22, 2015

Related U.S. Application Data

(60) Provisional application No. 61/856,715, filed on Jul. 21, 2013.

(51) Int. Cl.
*B66C 1/34* (2006.01)
*B66C 1/44* (2006.01)
*E21B 19/06* (2006.01)

(52) U.S. Cl.
CPC ..... *B66C 1/44* (2013.01); *E21B 19/06* (2013.01)

(58) Field of Classification Search
CPC .... B66C 1/44; B66C 1/34; B66C 1/36; E21B 19/06; F16B 45/06; F16B 45/02; F16B 45/04
USPC ..... 294/82.32, 82.34, 82.31, 82.33, 102.1, 294/102.2
See application file for complete search history.

(56) References Cited

U.S. PATENT DOCUMENTS

| | | | | |
|---|---|---|---|---|
| 1,124,790 | A * | 1/1915 | Nedrow | B66C 1/34 294/82.32 |
| 1,842,040 | A * | 1/1932 | McConnell | B66C 1/34 24/132 WL |
| 2,109,493 | A * | 3/1938 | Lundeen | E21B 19/07 188/67 |
| 2,879,099 | A * | 3/1959 | Riedesser | B66C 1/38 294/110.1 |
| 4,336,637 | A * | 6/1982 | Patterson | B25B 13/463 188/67 |
| 5,100,192 | A * | 3/1992 | McMillan | B63B 21/04 294/82.31 |
| 6,654,990 | B2 * | 12/2003 | Liu | F16B 45/025 24/598.5 |
| 9,422,777 | B2 * | 8/2016 | Foley | E21B 19/06 |
| 2009/0120649 | A1 * | 5/2009 | Cerovsek | E21B 19/10 166/380 |
| 2013/0277524 | A1 * | 10/2013 | Fathi | F16B 45/02 248/308 |

* cited by examiner

*Primary Examiner* — Gabriela Puig
(74) *Attorney, Agent, or Firm* — Ted M. Anthony

(57) ABSTRACT

A clamp assembly provides an attachment point for securely gripping pipe or other tubular goods including, without limitation, a section of coiled tubing. The clamp assembly beneficially includes a pad-eye member for attaching the clamp assembly (and any attached tubing) to a hook of a crane or other lifting mechanism. The clamp assembly also prevents partially unspooled coiled tubing from re-winding through a winding guide of a spool, thereby maintaining a distal outer end of the coiled tubing in an easily accessible location.

14 Claims, 9 Drawing Sheets

TUBING CLAMP ASSEMBLY

BACKGROUND OF THE INVENTION

1. Field of the Invention

The present invention pertains to a clamp assembly for gripping a length of pipe and providing a means for attaching said pipe to a lifting means such as, for example, a crane. More particularly, the present invention pertains to a clamp assembly for use in safely and efficiently guiding and threading a length of continuous tubing from a spool or reel into and out of an injector head. More particularly still, the present invention pertains to a clamp assembly that can remain attached to a length of continuous tubing to prevent said tubing from passing through a guide on a reel or coil.

2. Brief Description of the Prior Art

In servicing oil and gas wells, a continuous length of pipe, generally referred to as "coiled tubing", can be used. Such coiled tubing generally comprises a length of continuous pipe wrapped on a spool, such that a desired length of tubing may be unspooled from said spool, passed through an injector head mounted on a well and injected into said well. After operations are completed, said coiled tubing can be retracted from the well and wound back on said spool.

During setup of a coiled tubing operation, a crane or other lifting device is frequently used to move the outer end of a length of continuous tubing from a spool to an injector, both of which can be positioned twenty feet or more above the ground or other support surface. In order to accomplish such transfer, it is generally necessary to connect said crane or other lifting means to said tubing at or near the outer end of said tubing. Once said crane or other lifting means is securely attached to said tubing, the end of the tubing can be lifted and laterally moved (and partially unspooled) to the intake of an injector head.

Once a well service operation is complete, the process is typically reversed. Coiled tubing is retracted from a well until the distal end of said tubing reaches the intake of an injector head. Thereafter, a crane or other lifting device is connected to said outer end of said tubing, and moved laterally to said spool from said injector head while the tubing is reeled back on to said spool.

When a length of coiled tubing is fully wrapped on a spool, the outer end of said tubing can pull through the wind guide of said spool assembly, thereby making said outer end difficult to access. Consequently, it is generally advantageous to provide a means to prevent an outer end of said coiled tubing from being pulled completely through said guide toward said spool, thereby becoming loose on the reel and difficult to access.

Conventional tubing clamps are typically connected to a length of coiled tubing to provide an attachment means for attaching a crane or other lifting apparatus to said tubing. Such conventional tubing clamps generally comprise a plurality of pad-eyes—typically two (2)—disposed on a top face of said tubing clamp. A crane or other lifting means can then be connected to said pad eyes using slings or other connection means.

Conventional tubing clamps are generally not easy to use or reliable in terms of gripping strength. Further, conventional tubing clamps typically require a double leg sling set in order to attach to said clamp; such double leg sling sets are less readily available than other sling sets, and can take longer to connect and disconnect than other attachment means.

Thus, there is a need for a tubing clamp having a single lifting eye member that can attach to a crane hook, thereby beneficially providing a significant improvement in safety of operation as well as efficiency.

SUMMARY OF THE INVENTION

The clamp assembly of the present invention comprises two opposing semi-circular members pivotally attached to a central pad-eye member. Said opposing semi-circular members can be closed around the exterior surface of a section of pipe or other tubular member (such as, for example, a length of coiled tubing) and then locked in place.

In a preferred embodiment, each of said semi-circular members further comprises a removable gripping die member adapted to contact the external surface of said pipe. Said removable die members have a plurality of inwardly facing teeth-like projections; when closed against a section of pipe, said projections increase the frictional forces acting between said pipe and said clamp assembly, and securely grip against the external surface of said pipe.

Said removable dies of the present invention can be beneficially removed and replaced when damaged, or when normal wear and tear erodes said projections. Such removable die members advantageously allow for quick and efficient interchangeability of said removable dies. Further, said removable dies can be changed without requiring disposal of an entire coiled tubing clamp assembly. Thus, the removable dies of the present invention advantageously allow for a more efficient clamping assembly.

Said central lifting pad-eye member includes an aperture for quick and secure connection to a crane or other hoisting mechanism, typically using slings or other similar linkage device. Once attached to a crane or other lifting device, an outer end of a length of continuous tubing can be lifted and laterally moved from a spool to an injector head. The clamp assembly of the present invention securely grips said tubing, and permits axial loading (such as, for example, when the pipe is being unspooled and laterally moved from a spool to an injector head). Further, said clamp assembly permits secure gripping of pipe having a relatively constant outer diameter with no outer "upsets" or loading shoulders.

Additionally, the clamp assembly of the present invention can prevent the outer distal end of a length of continuous tubing from re-winding through a winding guide of a spool, thereby allowing said end to remain easily accessible. Without the clamp assembly of the present invention, such coiled tubing can pull back through said guide toward said spool, ultimately resting in an inaccessible or inconvenient position.

The clamp assembly of the present invention significantly increases the safety of a coiled tubing operation by providing a means for securely gripping a section of coiled tubing. Said clamp assembly beneficially includes a pad-eye member for attaching said clamp assembly of the present invention (and any attached tubing) to the hook of a crane or other lifting mechanism. The tubing clamp assembly of the present invention can grip and support coiled tubing via a crane or other hoisting mechanism such as, for example, when an outer or distal end of such coiled tubing is moved from a spool to an injector head or vice versa.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
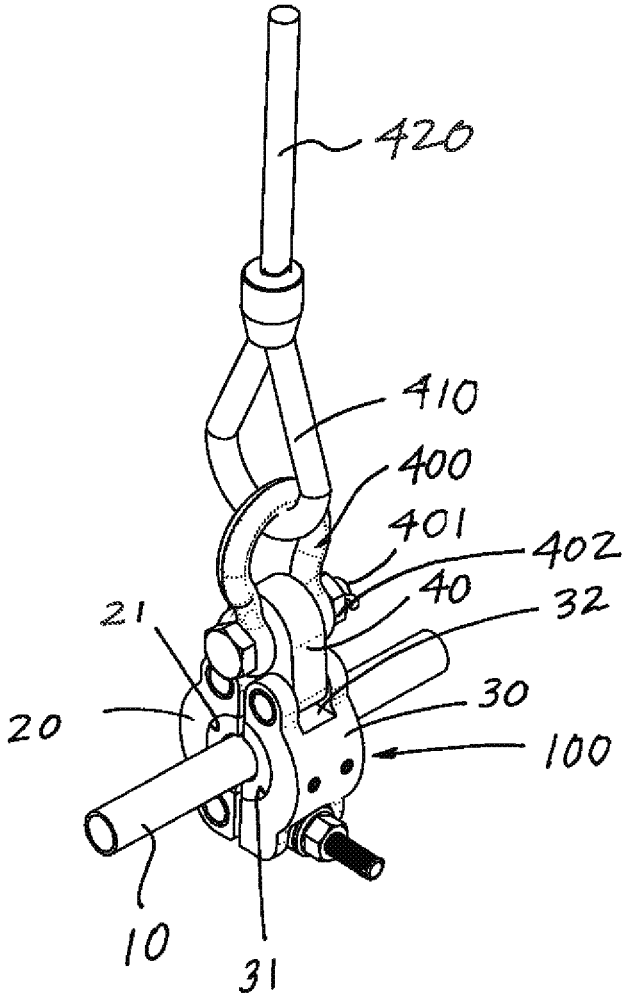
FIG. 1 depicts a side perspective view of a preferred embodiment of a clamp assembly of the present invention in a closed position gripping a section of pipe and connected to a crane hook.

Referring to the drawings, FIG. 1 depicts a perspective view of a tubing clamp assembly 100 of the present invention attached to a shackle 400 and disposed around the outer surface of a section of pipe 10. As depicted in FIG. 1, tubing clamp assembly 100 generally comprises a first half member 20, a second half member 30, and a central lifting pad-eye member 40 disposed between said first and second half members. First half member 20 and second half member 30 are pivotally attached to said central pad-eye member 40, as discussed in detail below.

In a preferred embodiment, said first half member 20 and said second half member 30 are each substantially semi-cylindrical in shape, with each half member defining a substantially semi-cylindrically shaped inner surface; first half member 20 has semi-cylindrical inner surface 21, while second half member 30 has semi-cylindrical inner surface 31. When joined together as depicted in FIG. 1, said first and second half members 20 and 30 cooperate to form a clamping structure, with said curved inner surfaces 21 and 31 cooperating to form a concentric and substantially cylindrical through bore. A recessed notch 22 (not visible in FIG. 1) is formed near the upper surface of first half member 20, while recessed notch 32 is formed near the upper surface of second half member 30; when said first and second half members 20 and 30 are joined together as depicted in FIG. 1, said mid-plane recessed notches 22 and 32 are aligned with each other.

Still referring to FIG. 1, shackle 400 is attached to an aperture passing through central pad-eye member 40, with shackle bolt 401 being received within said aperture and being secured in place using shackle nut 402. Loop 410 of cable 420 passes through said shackle 400. Although not depicted in FIG. 1, said cable 420 can comprise a portion of a cable sling member which is itself connected to a hook of a crane or other hoisting device. As depicted in the appended drawings, pipe section 10 comprises a section of continuous tubing, such as coiled tubing or the like. However, it is to be observed that clamp assembly 100 is not limited to use solely with continuous tubing, and can also be used with jointed pipe or other tubular goods.

Figure 2:
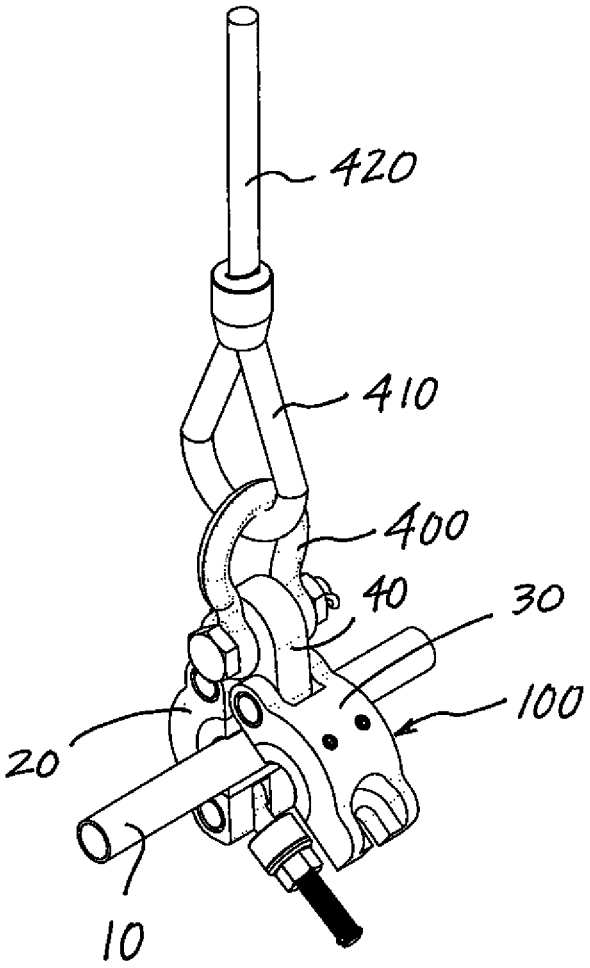
FIG. 2 depicts a side perspective view of a preferred embodiment of a clamp assembly of the present invention in a partially open position and connected to a shackle.

FIG. 2 depicts a side perspective view of a preferred embodiment of a clamp assembly 100 of the present invention in a partially open position and connected to shackle 400. As depicted in FIG. 2, tubing clamp 100 generally comprises a first half member 20, a second half member 30, and a lifting eye member 40 disposed between said first and second half members. First half member 20 and second half member 30 are each pivotally attached to central pad-eye member 40, but are not secured together as depicted in FIG. 1; thus, first half member 20 and second half member 30 are capable of partially separating (that is, opening relative to pipe section 10) as depicted in FIG. 2.

Figure 3:
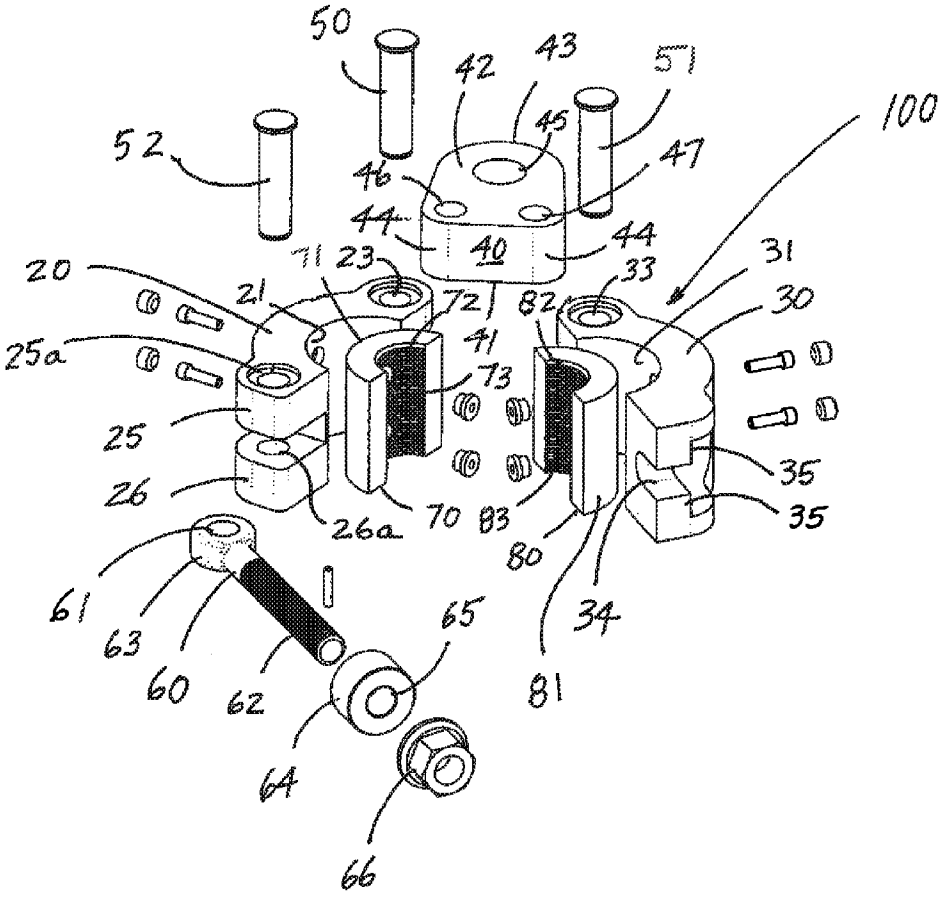
FIG. 3 depicts an exploded side perspective view of a preferred embodiment of a clamp assembly of the present invention.

FIG. 3 depicts a partially exploded perspective view of a clamp assembly 100 of the present invention generally comprising first half member 20, second half member 30, and a central lifting pad-eye member 40 disposed between said first and second half members. First half member 20 and second half member 30 are each pivotally attached to central pad-eye member 40.

In a preferred embodiment, said lifting pad-eye member 40 comprises a substantially planar body member defining substantially flat surfaces 41 and 42, upper rounded edge 43 and lower rounded corner sections 44. A plurality of apertures 45, 46 and 47 extend through said body member and are oriented substantially normal to said substantially flat surfaces 41 and 42. Aperture 45 is positioned near upper rounded edge 43—or the apex of said lifting pad-eye member 40—while apertures 46 and 47 are positioned near lower rounded corner sections 44.

First half member 20 includes transverse bore 23, while second half member 30 includes transverse bore 33. When first half member 20 and second half member 30 are joined together, said transverse bores 23 and 33 are oriented substantially parallel to each other. Although not visible in FIG. 3, recessed notches 22 (of first half member 20) and 32 (of second half member 30) are aligned with each other to form a mid-plane elongate recess that receives central lifting pad-eye member 40.

When central lifting pad-eye 40 is received within said elongate slot formed by aligned recessed notches 22 and 32 (not visible in FIG. 3), aperture 46 in lifting pad-eye member 40 is aligned with transverse bore 23. Cylindrical bolt 50 is disposed through aperture 46 in lifting pad-eye member 40 and aligned transverse bore 23 in first half member 20. Said first half member 20 is capable of rotating relative to pad-eye member 40 about a pivot axis passing through the longitudinal axis of cylindrical bolt 50. Similarly, aperture 47 in lifting pad-eye member 40 is aligned with transverse bore 33 in second half member 30. Cylindrical bolt 51 is disposed through said aperture 47 in lifting pad-eye member 40 and aligned transverse bore 33. Said second half member 30 can rotate relative to pad-eye member 40 about a pivot axis passing through the longitudinal axis of cylindrical bolt 51.

Lower clevis bracket extensions 25 and 26 are disposed at one end of first half member 20, and are oriented substantially parallel to each other to form a clevis bracket. Aligned bores 25*a* and 26*a* extend through said clevis bracket extensions 25 and 26, respectively. Notch 34 is formed along one end of second half member 30 and defines outwardly facing shoulders 35. Said notch 34 is generally aligned with the gap formed between lower clevis bracket extensions 24 and 25.

Locking eye bolt 60 has head section 63 having transverse "eye" or bore 61 extending there through, as well as external threads 62. Head section 63 is disposed within a clevis bracket formed by substantially parallel clevis bracket extensions 25 and 26, such that transverse bore 61 is in alignment with bores 25*a* and 26*a* in clevis bracket extensions 25 and 26, respectively. Cylindrical bolt 52 is disposed through aligned bores 25*a*, 61 and 26*a*, such that locking eye bolt 60 is capable of rotating about a pivot axis passing through the longitudinal axis of said cylindrical bolt 52. Spacer sleeve 64 having central bore 65 can be slidably received on locking eye bolt 60, while nut 66 is threadably received on threads 62 of said locking eye bolt 60.

Still referring to FIG. 3, semi-cylindrical gripping die member 70 has convex outer surface 71 and concave inner surface 72. Said convex outer surface 71 is disposed against curved inner surface 21 of first half member 20. Similarly, semi-cylindrical gripping die member 80 has convex outer surface 81 and concave inner surface 82. Said convex outer surface 81 is disposed against curved inner surface 31 of second half member 30.

A plurality of gripping teeth projections 73 are disposed along and extend from inner surface 72 of die member 70, while a plurality of gripping teeth projections 83 are disposed along and extend from inner surface 82 of die member 80, Said teeth 73 and 83 create frictional forces that allow said teeth to firmly grip against an outer surface of a section of pipe, such as pipe section 10 depicted in FIGS. 1 and 2. Thus, when first half member 20 and second half member 30 are joined together, said teeth 73 and 83 firmly grip said pipe section 10.

Alternatively, it is to be observed that gripping teeth can also be formed on inner surfaces 21 and 31 of first half member 20 and second half member 30, respectively, in lieu of gripping die members 70 and 80. However, said die members 70 and 80 of the present invention can be beneficially removed and replaced when damaged, or when teeth 73 and 83 wear down. Removable die members 70 and 80 advantageously allow for quick and efficient interchangeability of said die members, eliminating the need for disposing of an entire clamp assembly 100 due to worn or damaged gripping teeth.

Figure 4:
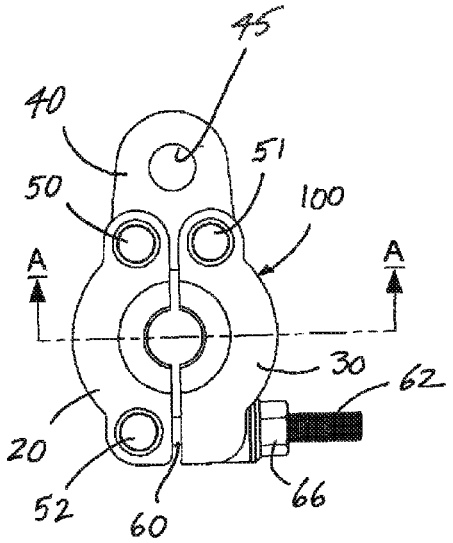
FIG. 4 depicts a side view of a clamp assembly of the present invention in a closed configuration.

FIG. 4 depicts a side view of a clamp assembly 100 of the present invention in a closed configuration. First half member 20 and second half member 30 are each pivotally attached to central pad-eye member 40. Aperture 45 is located near the apex of central pad-eye member 40. As depicted in FIG. 4, first half member 20 is rotated inward about cylindrical bolt 50, while second half member 30 is rotated inward about cylindrical bolt 51; in other words, said first half member 20 and second half member 30 are rotated toward each other. Locking eye bolt 60 is rotated about bolt 53 and positioned within notch 34 in second half member 30 (not visible in FIG. 4). Nut 66 is tightened on threads 62 of locking eye bolt 60 in order to force or bias said first half member 20 and second half member 30 toward each other and secure said half members in place.

Figure 5:
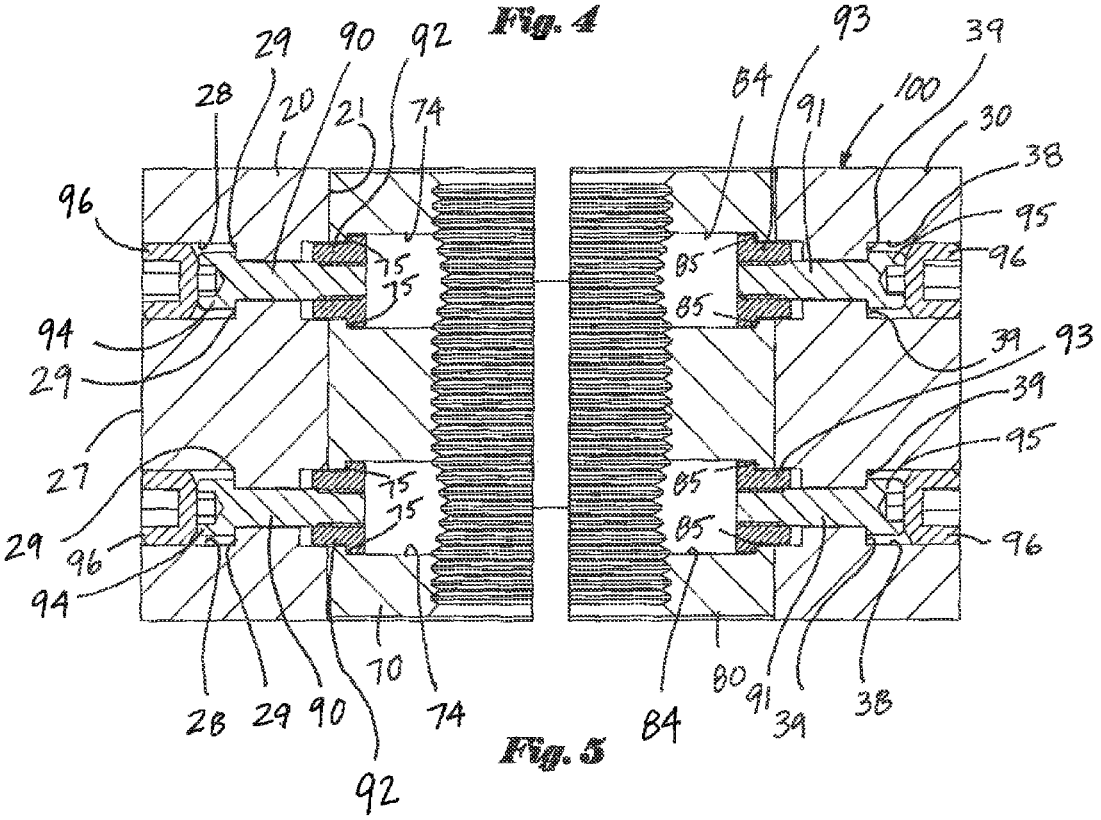
FIG. 5 depicts a side sectional view of clamp assembly along line A-A depicted in FIG. 4.

FIG. 5 depicts a side sectional view of said clamp assembly 100 along line A-A shown in FIG. 4. In a preferred embodiment depicted in FIG. 5, die members 70 and 80 are removably attached to first half member 20 and second half member 30, respectively. Bores 28 extend through first half member 20 from outer surface 27 to inner surface 21 and define inner shoulders 29, while bores 38 extend through second half member 30 from outer surface 37 to inner surface 31 and define inner shoulders 39. Similarly, bores 74 extend through die member 70 and define inner shoulders 75, while bores 84 extend through die member 80 and define inner shoulders 85.

Attachment bolts 90 are received within aligned bores 28 and 74 and are threadably attached to threaded fittings 92, while attachment bolts 91 are received within aligned bores 38 and 84 and are threadably attached to threaded fittings 93. Oversized heads 94 of bolts 90 seat against inner shoulders 29, while oversized heads 95 of bolts 91 seat against inner shoulders 39. Tightening of bolts 90 causes threaded fittings 92 to act against inner shoulders 29, thereby biasing die member 70 against inner surface 21 of first half member 20. Similarly, tightening of bolts 91 causes threaded fittings 93 to act against inner shoulders 39, thereby biasing die member 80 against inner surface 31 of second half member 30. Set screws 96 can be installed within bores 28 and 38 to protect attachment bolts 90 and 91, respectively, and prevent said bolts from inadvertently backing out.

Figure 6:
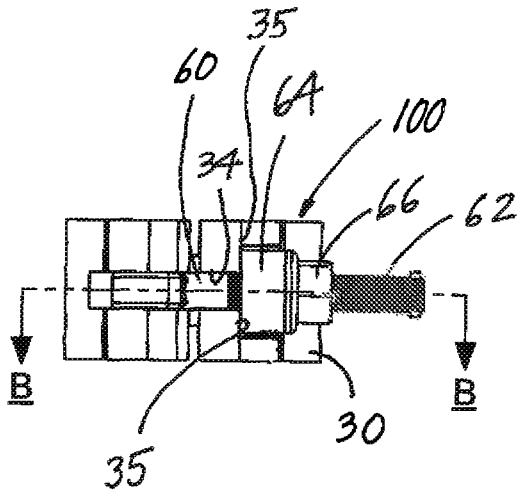
FIG. 6 depicts a bottom view of a clamp assembly of the present invention in a closed configuration.

FIG. 6 depicts a bottom view of clamp assembly 100 of the present invention in a closed configuration. Locking eye bolt 60 is positioned within notch 34 in second half member 30. Nut 66 is tightened on threads 62 of locking eye bolt 60 in order to force spacer sleeve 64 against shoulders 35 of second half member 30, thereby biasing said first half member 20 and second half member 30 toward each other. Nut 66 also acts to secure said first half member 20 and second half member 30 in place.

Figure 7:
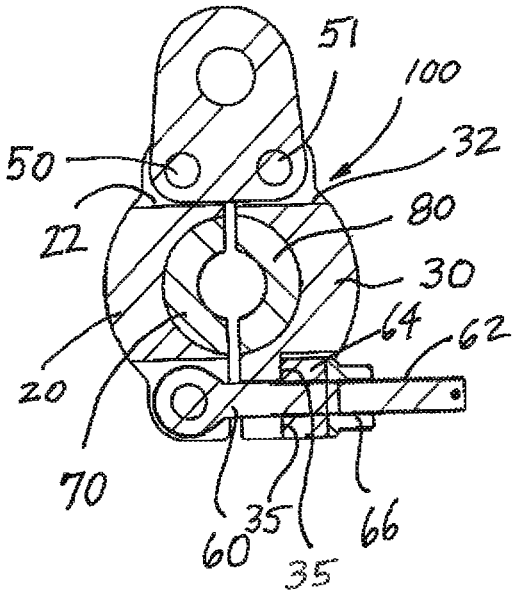
FIG. 7 depicts a sectional view of clamp assembly along line B-B depicted in FIG. 6.

FIG. 7 depicts a sectional view of said clamp assembly 100 along line B-B shown in FIG. 6. As depicted in FIG. 7, first half member 20 is rotated inward about cylindrical bolt 50, while second half member 30 is rotated inward about cylindrical bolt 51. Die member 70 is removably attached to first half member 20. Die member 80 is removably attached to half member 30. Nut 66 is tightened on threads 62 of locking eye bolt 60 in order to force spacer sleeve 64 against shoulders 35 of second half member 30, thereby biasing said first half member 20 and second half member 30 toward each other.

Still referring to FIG. 7, recessed notches 22 of first half member 20 and 32 of second half member 30 are aligned with each other to form a mid-plane elongate recess that receives the base of central lifting pad-eye member 40. Central lifting pad-eye 40 is received within said elongate slot formed by aligned recessed notches 22 and 32, and secured in place with cylindrical bolts 50 and 51.

Figure 8:
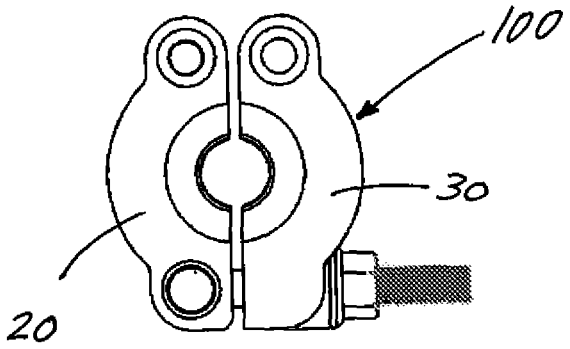
FIG. 8 depicts a side view of a clamp assembly of the present invention without a central pad-eye member.
Figure 9:
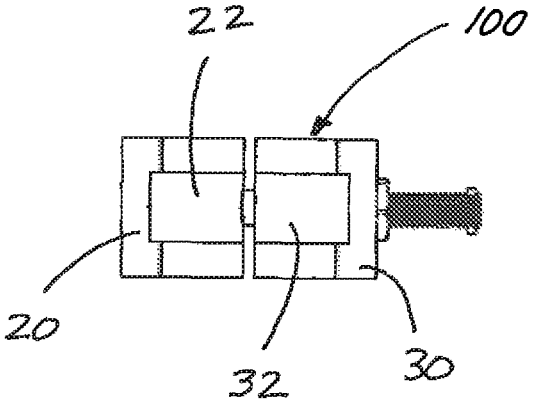
FIG. 9 depicts a top view of a clamp assembly of the present invention without a central pad-eye member.

FIG. 8 depicts a side view of clamp assembly 100 of the present invention without central pad-eye member 40 attached to first half member 20 and second half member 30. FIG. 9 depicts a top view of clamp assembly 100 of the present invention without central pad-eye member 40 installed. Referring to FIG. 9, recessed notch 22 in first half member 20 and recessed notch 32 in second half member 30 are aligned with each other and cooperate to form a mid-plane elongate recess that can receive the base of central lifting pad-eye member 40 (not shown in FIG. 9).

In operation, referring to FIG. 2, nut 66 can be loosened on threads 62 of locking eye bolt 60. When said nut 66 has moved a sufficient distance along said threads 62, spacer sleeve 64 is not biased or forced against shoulders 35 of second half member 30. Locking eye bolt 60 can then be rotated about bolt 53 and removed from notch 34 in second half member 30. In such a configuration, second half member 30 is capable of rotating about bolt 52 relative to central pad-eye member 40, thereby allowing said second half member 30 to move apart relative to first half member 20. In this manner, first half member 20 and second half member 30 can be opened or spread apart a sufficient distance to receive pipe section 10 between opposing die members 70 and 80.

Referring back to FIG. 1, after pipe section 10 has been received within separated opposing die members 70 and 80, first half member 20 is rotated inward about cylindrical bolt 50, while second half member 30 is rotated inward about cylindrical bolt 51. Locking eye bolt 60 is rotated about bolt 53 and positioned within notch 34 in second half member 30. Nut 66 is tightened on threads 62 of locking eye bolt 60 in order to force said first half member 20 and second half member 30 toward each other and secure said half members in place around the exterior surface of pipe section 10. In this manner, opposing die members 70 and 80 (each having a substantially semi-cylindrical inner surface) cooperate to contact and grip against the outer surface of substantially cylindrical pipe section 10.

Figure 10:
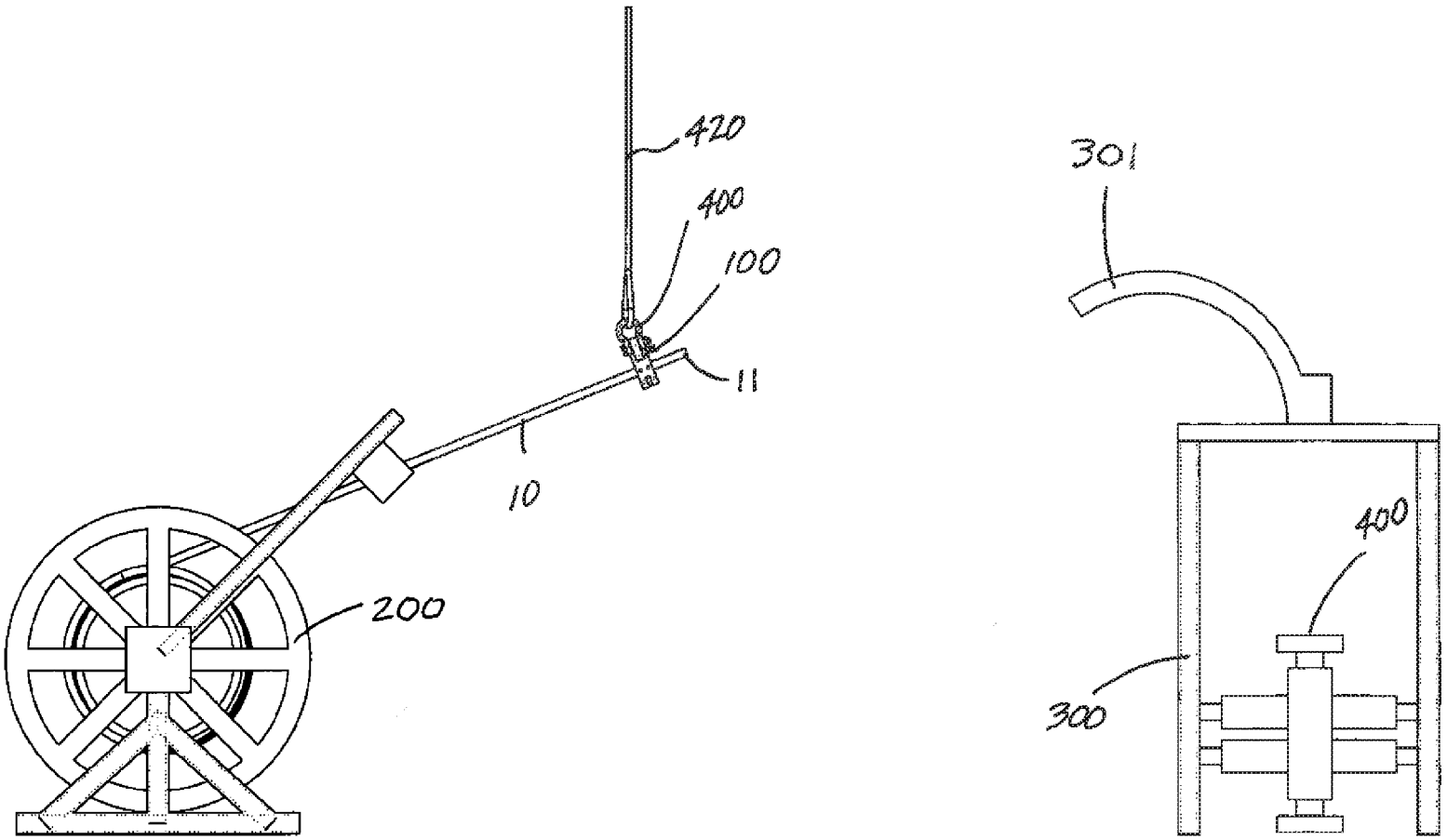
FIG. 10 depicts a side view of a clamp assembly of the present invention during the transfer of a length of coiled tubing from a spool to an injector head.

FIG. 10 depicts a side view of a clamp assembly of the present invention during the transfer of a length of coiled tubing 10 from a spool 200 to an injector head 300 having "goose neck" guide 301, which is used to direct tubing 10 from spool 200 (and, typically, a substantially horizontal orientation) into the upper opening of a well 400 (and, typically, a substantially vertical orientation) that penetrates subterranean formations. Said clamp assembly 100 can be quickly and securely connected to a crane or other hoisting mechanism, typically using sling 420 and shackle 400 or other similar linkage devices. Once attached to a crane or other lifting device, an outer distal end 11 of a length of continuous tubing 10 can be lifted and laterally moved from spool 200 to injector head 300.

Clamp assembly 100 of the present invention securely grips said tubing 10, and permits axial loading (such as, for example, when pipe 10 is being unspooled from spool 200 and laterally moved from said spool 200 to injector head 300). Subsequently, after a coiled tubing operation has been completed, tubing clamp 100 can be used to pull outer distal end 11 of coiled tubing 10 from injector head 300 toward spool 200 to facilitate the re-spooling process.

Figure 11:
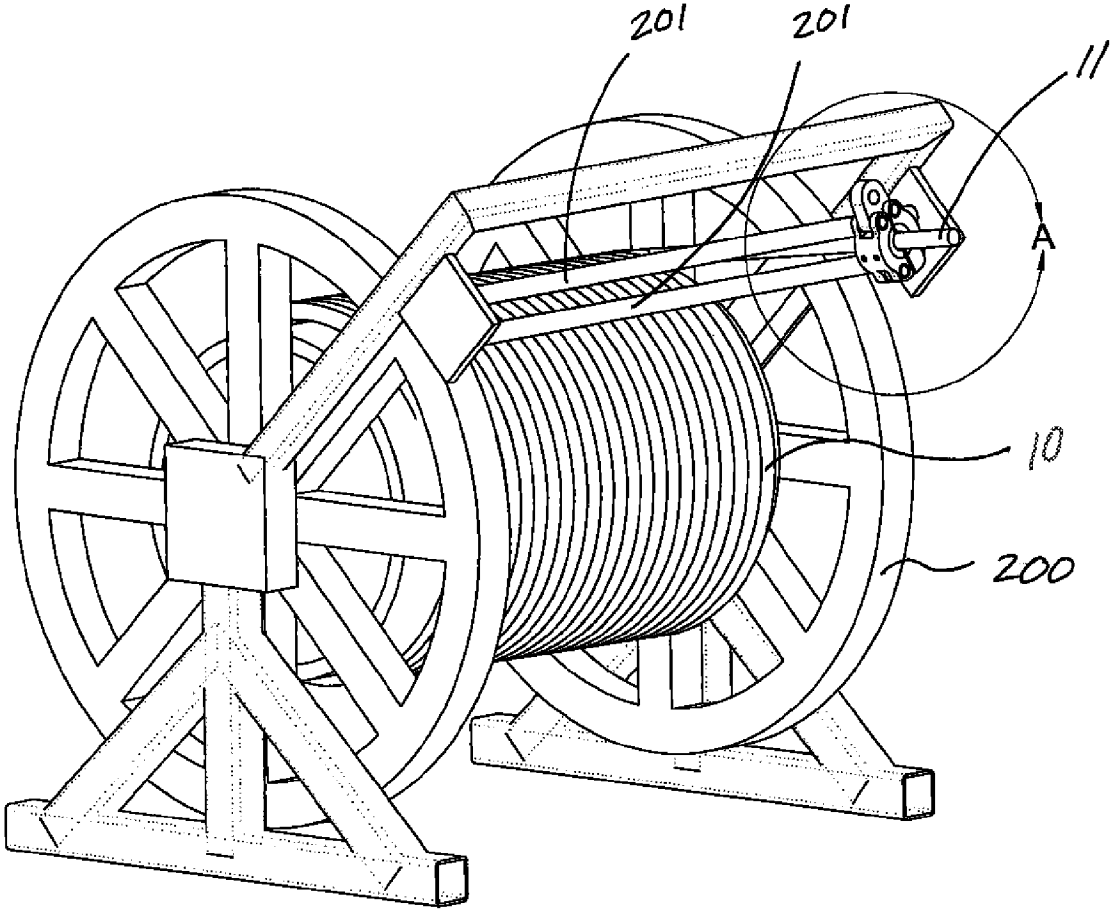
FIG. 11 depicts a side perspective view of a clamp assembly of the present invention attached to a length of coiled tubing on a spool.
Figure 12:
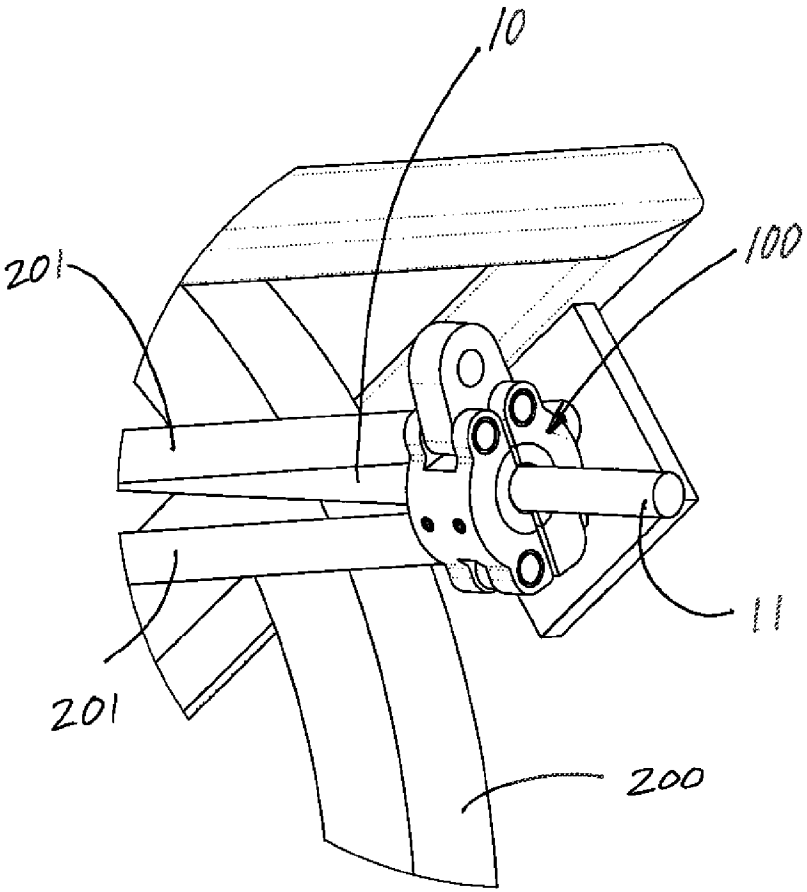
FIG. 12 depicts a detailed view of the highlighted area shown in FIG. 11.

FIG. 11 depicts a side perspective view of a clamp assembly 100 of the present invention attached to a length of coiled tubing 10 reeled on a spool 200, while FIG. 12 depicts a detailed view of the highlighted area shown in FIG. 11. Referring to FIG. 11, coiled tubing spool 200 can include winding guide 201 to facilitate orderly and efficient unwinding of coiled tubing 10 from spool 200, as well as rewinding of such tubing on said spool.

Referring to FIG. 12, in addition to other benefits described herein, clamp assembly 100 of the present invention can prevent the outer distal end 11 of a length of continuous tubing 10 from re-winding through a winding guide 201 of a spool 200, thereby allowing said end 11 to remain in an easily accessible position. Without clamp assembly 100 of the present invention preventing said distal end 11 from passing through winding guide 201, outer distal end 11 of coiled tubing 10 can pull through said guide 201 toward said spool 200, ultimately resting in an inaccessible or inconvenient position.

Clamp assembly 100 of the present invention significantly increases the safety of a coiled tubing operation by providing a means for securely gripping a section of coiled tubing. Said clamp assembly beneficially includes a pad-eye member for attaching said clamp assembly of the present invention (and any attached tubing) to the hook of a crane or other lifting mechanism. The tubing clamp assembly of the present invention can grip and support coiled tubing via a crane or other hoisting mechanism such as, for example, when an outer or distal end of such coiled tubing is moved from a spool to an injector head or vice versa.

Clamp assembly 100 including, without limitation, pivotal connection of first half member 20 and second half member 30 to central pad-eye member 40, as well as the disclosed means for securing said half members in place around a length of tubing, greatly improves the speed and efficiency with which clamp assembly 100 can be connected and disconnected from a section of pipe. Further, a single connection point (aperture 45) near the apex of said pad-eye member 40 allows for attachment of a single cable sling to clamp assembly 100, while permitting a wide range of movement of said clamp assembly 100 and said cable sling when suspended from a crane or other lifting device.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A clamp assembly for gripping an external surface of pipe or other tubular goods comprising:

a) a central pad-eye member having at least one aperture adapted to be connected to a lifting apparatus;

b) a first half member pivotally attached to said central pad-eye member having a first substantially semi-cylindrical inner surface;

c) a second half member pivotally attached to said central pad-eye member having a second substantially semi-cylindrical inner surface, wherein said first and second half members can be biased toward each other so that said first and second inner surfaces cooperate to form a substantially cylindrical bore;

d) a plurality of gripping teeth disposed on said first and second inner surfaces.

2. The clamp assembly of claim 1, further comprising a locking assembly for securing said first and second half members together.

3. The clamp assembly of claim 1, wherein said central pad-eye member further comprises a substantially planar body defining an apex.

4. The clamp assembly of claim 3, wherein said at least one aperture is disposed adjacent to said apex.

5. A clamp assembly for gripping an external surface of pipe or other tubular goods comprising:

a) a central pad-eye member having at least one aperture adapted to be connected to a lifting apparatus;

b) a first half member pivotally attached to said central pad-eye member;

c) a first die member removably attached to said first half member, wherein said first die member defines a first substantially semi-cylindrical inner surface;

d) a second half member pivotally attached to said central pad-eye member;

e) a second die member removably attached to said second half member, wherein said second die member defines a second substantially semi-cylindrical inner surface, and said first and second die members cooperate to form a substantially cylindrical bore when said first and second half members are joined together; and f) a plurality of gripping teeth disposed on said first and second inner surfaces.

6. The clamp assembly of claim 5, further comprising a locking assembly for securing said first and second half members together.

7. The clamp assembly of claim 6, wherein said locking assembly further comprises:

a) a bolt having threads pivotally attached to said first half member;

b) a nut threadably received on said bolt; and c) a notch defining load shoulders on said second half member.

8. The clamp assembly of claim 5, wherein said central pad-eye member further comprises a substantially planar body defining an apex.

9. The clamp assembly of claim 8, wherein said at least one aperture is disposed adjacent to said apex.

10. A method for conducting operations on a well using continuous tubing on a spool comprising:

a) attaching a clamp assembly to an external surface of said tubing, wherein said clamp assembly comprises:

i) a central pad-eye member having at least one aperture adapted to be connected to a lifting apparatus;

ii) a first half member pivotally attached to said central pad-eye member having a first substantially semi-cylindrical inner surface;

iii) a second half member pivotally attached to said central pad-eye member having a second substantially semi-cylindrical inner surface, wherein said first and second half members can be biased toward each other so that said first and second inner surfaces cooperate to form a substantially cylindrical bore;

iv) a plurality of gripping teeth disposed on said first and second inner surfaces;

b) connecting said clamp assembly to a lifting apparatus;

c) moving said tubing from said spool to an injector head using said lifting apparatus to support said tubing;

d) disconnecting said clamp assembly from said lifting apparatus; and e) removing said clamp assembly from said tubing.

11. The method of claim 10, further comprising a locking assembly for securing said first and second half members together.

12. The method of claim 11, wherein said locking assembly further comprises:

a) a bolt having threads pivotally attached to said first half member;

b) a nut threadably received on said bolt; and c) a notch defining load shoulders on said second half member.

13. The method of claim 10, wherein said central pad-eye member further comprises a substantially planar body defining an apex.

14. The method of claim 13, wherein said at least one aperture is disposed adjacent to said apex.

* * * * *